US009254495B2

(12) United States Patent
Zhou et al.

(10) Patent No.: US 9,254,495 B2
(45) Date of Patent: Feb. 9, 2016

(54) SHOWER WITH A SLIDING BODY

(75) Inventors: Huasong Zhou, Xiamen (CN); Hexian Cai, Xiamen (CN); Jianmin Chen, Xiamen (CN)

(73) Assignees: XIAMEN SOLEX HIGH-TECH INDUSTRIES CO., LTD., Xiamen, P.R. (CN); Huasong Zhou, Xiamen, P.R. (CN)

( * ) Notice: Subject to any disclaimer, the term of this patent is extended or adjusted under 35 U.S.C. 154(b) by 710 days.

(21) Appl. No.: 13/517,095

(22) PCT Filed: Dec. 20, 2010

(86) PCT No.: PCT/CN2010/079991

§ 371 (c)(1),
(2), (4) Date: Jun. 19, 2012

(87) PCT Pub. No.: WO2011/076094

PCT Pub. Date: Jun. 30, 2011

(65) Prior Publication Data

US 2012/0247017 A1 Oct. 4, 2012

(30) Foreign Application Priority Data

Dec. 21, 2009 (CN) ..... 2009 1 0215319
Dec. 21, 2009 (CN) ..... 2009 2 0351017 U

(51) Int. Cl.
*A47K 3/28* (2006.01)
*B05B 1/18* (2006.01)
*B05B 1/16* (2006.01)

(52) U.S. Cl.
CPC ..... *B05B 1/1654* (2013.01); *B05B 1/18* (2013.01)

(58) Field of Classification Search
CPC ..... B05B 1/14; B05B 1/18; B05B 1/1663; B05B 1/1672; E03C 1/04909
USPC ..... 4/615, 675, 676, 678; 239/390–397, 239/436–438, 442–444, 548, 553.5, 556, 239/561, 562, 566, 567, 587.4; 137/801
See application file for complete search history.

(56) References Cited

U.S. PATENT DOCUMENTS 2,333,767 A 11/1943 Davis
3,724,760 A * 4/1973 Smith ..... 239/282

(Continued)

FOREIGN PATENT DOCUMENTS

CN 201026470 Y 2/2008
CN 201067718 Y 6/2008

(Continued)

*Primary Examiner* — Paul R Durand
*Assistant Examiner* — Nicholas Ros
(74) *Attorney, Agent, or Firm* — Rabin & Berdo, P.C.

(57) ABSTRACT

The present invention is provided with a shower with a sliding body, which includes a handle and an outlet unit. the handle is disposed with an inlet waterway. The inlet waterway is disposed with an inlet hole on the obverse side of the handle; the outlet unit is disposed with at least two outlets, each outlet is disposed with an outlet hole on the reverse side of the outlet unit, the outlet holes are interval disposed along the X direction; The handle is connected to the outlet unit with sliding along the X direction, the obverse side of the handle and the reverse side of the outlet unit are sealing connected together, making the inlet hole connecting to one of the outlet holes. The present invention without the pushing button and the linkage mechanism, reduces the cost and simplify the structure, providing a new switch experience for the user.

15 Claims, 8 Drawing Sheets

(56) References Cited

U.S. PATENT DOCUMENTS

| | | | | | |
|---|---|---|---|---|---|
| 4,714,200 | A | | 12/1987 | Sayama | |
| 5,742,961 | A | * | 4/1998 | Casperson et al. | 4/615 |
| 6,622,947 | B1 | * | 9/2003 | Rivera | 239/566 |
| 7,793,365 | B2 | * | 9/2010 | Miura et al. | 4/678 |
| 2004/0217209 | A1 | * | 11/2004 | Bui | 239/548 |
| 2010/0301141 | A1 | * | 12/2010 | Pan | 239/449 |

FOREIGN PATENT DOCUMENTS

| | | | | | |
|---|---|---|---|---|---|
| CN | 101767070 | A | | 7/2010 | |
| CN | 101786052 | A | | 7/2010 | |
| CN | 201565373 | U | | 9/2010 | |
| CN | 201603634 | U | | 10/2010 | |
| FR | 2606296 | A1 | | 5/1988 | |
| GB | 2048721 | | * | 12/1980 | B05B 1/16 |
| GB | 2048721 | A | | 12/1980 | |

* cited by examiner

SHOWER WITH A SLIDING BODY

FIELD OF THE INVENTION

The present invention relates to a bath shower, especially to a shower with a sliding body, of which the outlet function switch realized by the sliding outlet unit itself.

BACKGROUND OF THE INVENTION

The existing shower with the function switch realized by sliding, for example the utilities with patent number ZL200720109472.6 and ZL200720006708.3 in the Chinese patent database, includes a handle and a body. The body includes a water diversion body and a water diversion sliding board. The water diversion body is disposed with at least two function holes. The water diversion sliding board is disposed with holes connected to the function holes of the water diversion body to realize the function switch. The handle is sliding disposed with a pushing button. The body is disposed with linkage mechanism inside. One end of the linkage mechanism is connected to the pushing button and the other end is connected to the water diversion sliding board. As known with the above description, the water diversion body and the handle are fixed, and the function switch is realized by the sliding of the water diversion sliding board. The disadvantages are below: it needs the pushing button to be disposed in the body for the operation of the user, a linkage mechanism is further needed to connect to the water diversion sliding board and the pushing board with a complex struction.

SUMMARY OF THE INVENTION

The present invention is provided with a shower with a sliding body, which solves the problem of the existing shower with the function switch realized by sliding with complex structure.

The technical proposal of the present invention is:

A shower with a sliding body includes:

A handle, which is disposed with an inlet waterway, the inlet waterway is disposed with an inlet hole disposed in the obverse side of the handle; and A outlet unit, which is disposed with at least two outlets, each outlet is disposed with an outlet hole disposed in the reverse side of the outlet unit, the outlet holes are interval disposed along the X direction;

The handle is connected to the outlet unit with sliding along the X direction, the obverse side of the handle and the reverse side of the outlet unit are sealed connected together, making the inlet hole is connected to one of the outlet holes.

In another preferred embodiment, the inlet waterway includes a lengthwise waterway with one end connected to the water source and a lateral waterway connected to the other end of the lengthwise waterway, the inlet hole is disposed in the lateral waterway; a leather cup and a elastic body is disposed inside the lateral waterway, the leather cup is sliding connected to the lateral waterway, the elastic body is disposed inside the lateral waterway and withstood the leather cup to make the leather cup sealing contacted with the reverse side of the outlet unit.

In another preferred embodiment, the present invention further includes at least a connection mechanism, which includes a sliding hole run through the obverse and the reverse sides of the handle and staggered with the inlet waterway, a connection base raised on the reverse side of the outlet unit and a sliding board sliding connected to the reverse side of the handle, the connection base is extended into the sliding hole and fixed to the sliding board, the connection base slides relative to the sliding hole in the X direction.

In another preferred embodiment, the sliding hole is ladder shaped hole, the sliding board is sliding connected to the ladder face of the ladder shaped hole.

In another preferred embodiment, the connection mechanism further includes a cover, which is covered on the sliding hole.

In another preferred embodiment, the ladder face is disposed with a ball, the sliding board is connection on the ball to transform the sliding friction to the rolling friction.

In another preferred embodiment, the outlet unit includes a body and a cap, the periphery of the cap is extended upwards to form an external wall, an inner base is fixedly disposed on the cap, which is sealing connected to the body, making the inner base to be formed a first outlet cavity and a second outlet cavity between the inner base and the external wall, the first outlet cavity and the second outlet cavity are separately connected to two outlet holes.

In another preferred embodiment, the reverser side of the fixed unit is concaved disposed with limiting holes corresponding to the outlets, the obverse side of the handle is concaved disposed with a groove, which is disposed with a spring and a stop pin withstood by the spring to push one of the limiting holes.

Another technical proposal of the present invention is:

A shower with a sliding body includes:

A handle, which is disposed with an inlet waterway, the inlet waterway is disposed with an inlet hole disposed in the obverse side of the handle; and An outlet unit, which is disposed with at least two outlets;

The handle is connected to the outlet unit with sliding along the X direction, the obverse side of the handle and the reverse side of the outlet unit are sealed connected together.

In another preferred embodiment, the outlet unit includes a fixed outlet unit and a sliding outlet unit to be formed at least two outlets; the fixed outlet unit is disposed in the fixed cavity of the handle, the sliding outlet unit is sliding connected to the sliding cavity of the handle.

In another preferred embodiment, the sliding outlet unit includes a sliding board, which is disposed with an inlet hole; the inlet hole is connected or disconnected to the inlet waterway to realize the switch of the outlets.

Compared to the background of the invention, the present invention has advantages below:

Firstly, the present invention is provided without the pushing button and the linkage mechanism, the cost is reduced, and the structure is simple, providing a new switch experience for the user; secondly, the present invention is provided with leather cup and elastic body, which realizes the axial sealing and radial sealing simultaneously with well sealing performance; thirdly, the outlet unit is connected to the handle through sliding board, the connection base and the sliding hole, making the assembly quick and fast with solid connection; fourthly, the sliding hole is covered by cover, preventing the dust to enter into the sliding hole to effect the sliding connection; fifthly, the ladder face is disposed with ball, and the sliding board is connected on the ball, transforming the sliding friction to the rolling friction to reduce the friction; sixthly, the stop pin and the limiting hole is disposed to keep the outlet function status.

BRIEF DESCRIPTION OF THE DRAWINGS

The present invention is further described with the drawings and the embodiment.

REFERENCE SIGNS

Figure 1:
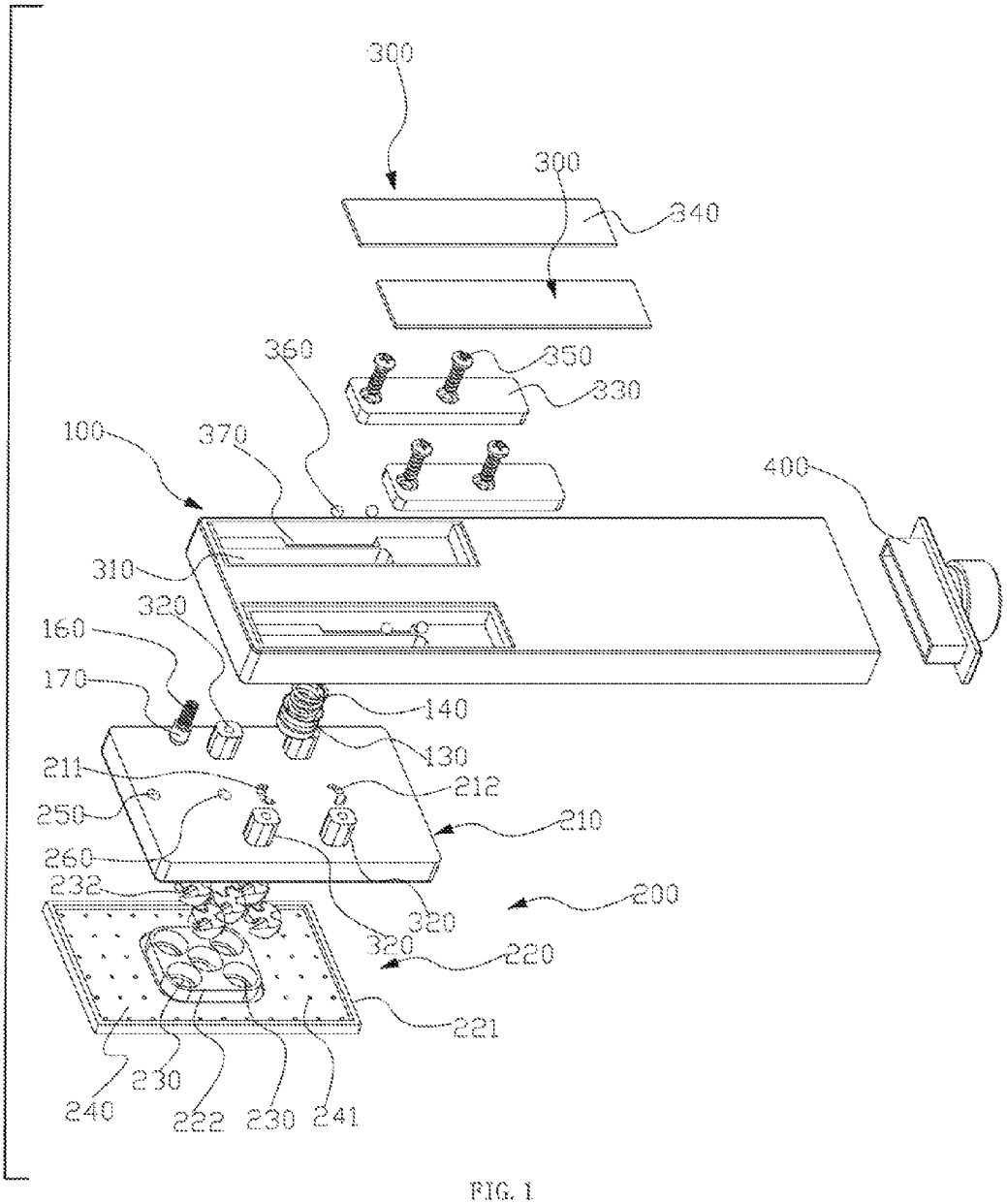
FIG. 1 illustrates the first breakdown structure of the shower with a sliding body in the first embodiment of the present invention.
Figure 2:
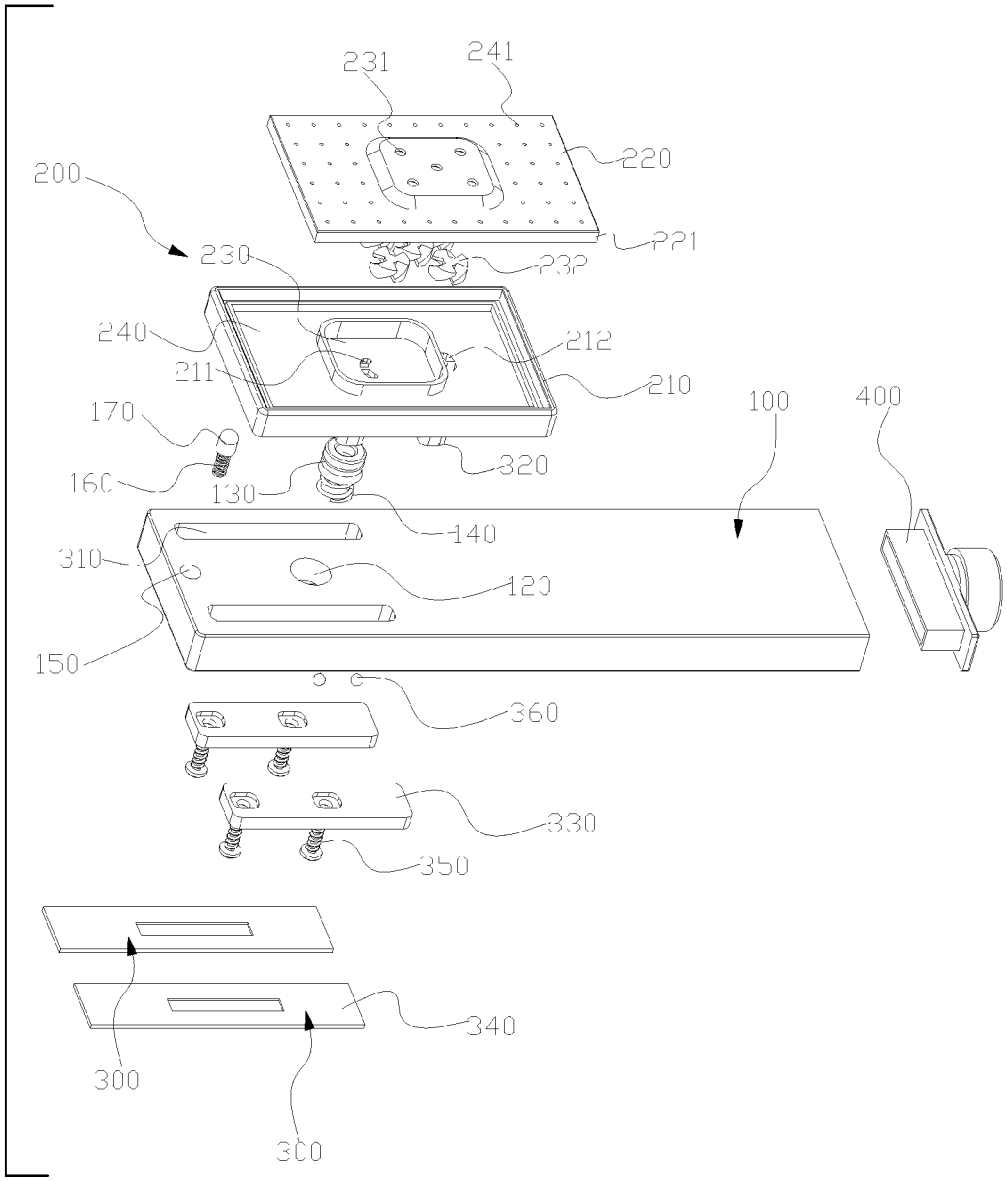
FIG. 2 illustrates the second breakdown structure of the shower with a sliding body in the first embodiment of the present invention.

Handle 100, outlet unit 200, connection mechanism 300, plug base 400, lengthwise waterway 110, lateral waterway 120, leather cup 130, the first spring 140, the body 210, the cap 220, the external wall 221, the inner base 222, the first outlet cavity 230, the second outlet cavity 240, the first outlet nozzle 231, diverter 232, the second outlet nozzle 241, the first outlet hole 211, the second outlet hole 212, the sliding hole 310, the connection base 320, the sliding board 330, the cover 340, the bolt 350, the ball 360, the limit hole 250, 260, the groove 150, the second spring 160, the locating pin 170.

DETAILED DESCRIPTION OF THE EMBODIMENT

The First Embodiment

Figure 6:
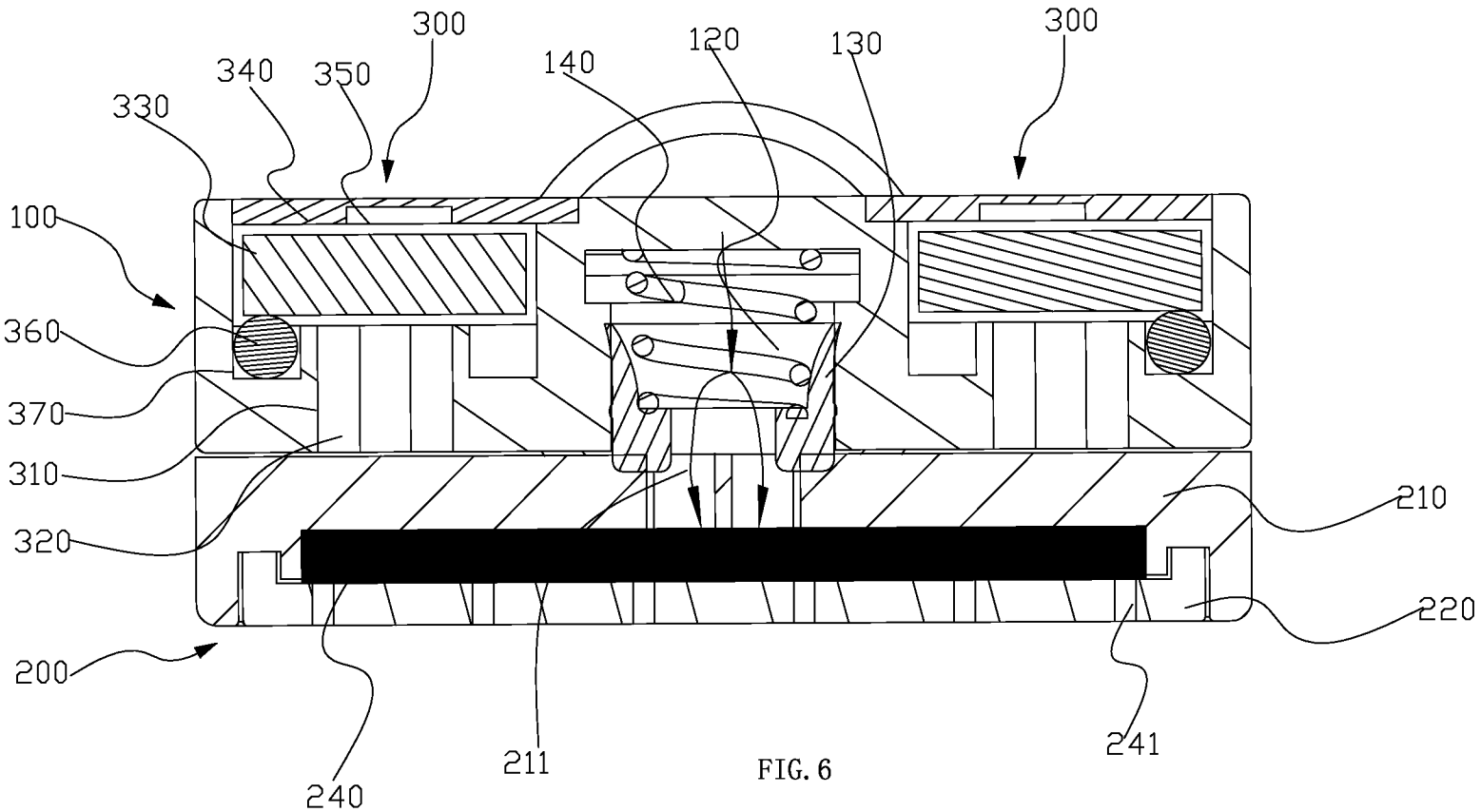
FIG. 6 illustrates the lateral sectional view of the first embodiment of the present invention when the shower with a sliding body is situated in shower function.

Please refer to the FIG. 1 to the FIG. 6, the structure of the shower with a sliding body is illustrated in the present invention.

The shower with a sliding body includes a handle 100, an outlet unit 200 and two connection mechanisms 300.

The handle 100 is connected to the water source through the plug base 400, the handle 100 is disposed with an inlet waterway, which includes a lengthwise waterway 100 with one end connected to the water source and a lateral waterway 120 connected to the other end of the lengthwise waterway 110, the outlet of the lateral waterway 120 is disposed in the obverse side of the handle 100 to be formed an inlet hole, making the water from the water source flowing into the lengthwise waterway 110 through the plug base 400, then into the lateral waterway 120 and out from the inlet hole. A leather cup 130 and a first spring 140 are disposed inside the lateral waterway 120, the leather cup 130 is sliding connected to the lateral waterway 120, the first spring 140 is disposed inside the lateral waterway 120 and withstood the leather cup 130, making the leather cup 130 sealed contacted to the reverse side of the body 210.

The outlet unit 200 includes a body 210 and a cap 220. The periphery of the cap 220 is extended upwards to form an external wall 221, an inner base 222 is fixedly disposed on the cap 220, which is sealing connected to the body 210, making the inner base 222 to be formed a first outlet cavity 230 and a second outlet cavity 240 between the inner base 222 and the external wall 221, a first outlet 231 is disposed in the portion of the cap 220 corresponding to the first outlet cavity 230, a diverter 232 is disposed inside the first outlet 231, making the water spraying out from the first outlet cavity 230. That is the spray function. A second outlet nozzle 241 is disposed in the portion of the cap 220 corresponding to the second outlet cavity 240, making the water flowing out of the second outlet cavity 240. That is the shower function. A first outlet hole 211 and a second outlet hole 212 are disposed on the body 210, the first outlet hole 211 is connected to the first outlet cavity 230, the second outlet hole 212 is connected to the second outlet cavity 240. The first outlet hole 211 and the second outlet hole 212 is interval arranged in the X direction. In this embodiment, the X direction is lengthwise for connect to the inlet hole of the handle 100 correspondingly. In this embodiment, the two outlet functions are spray function and shower function, but not limited with other outlet functions. There are two outlet functions in this embodiment, but not limited with three outlet functions or four.

The two connection mechanisms 300 are bilateral symmetry arranged.

The connection mechanism 300 includes a sliding hole 310 run through the obverse and the reverse sides of the handle 100 and staggered with the inlet waterway, a connection base 320 raised on the reverse side of the body 210 and a sliding board 330 and a cover 340. The sliding hole 310 is ladder shaped, which includes a small hole corresponding to the obverse side of the handle 100, a big hole corresponding to the reverse side of the handle 100 and a ladder side between the small hole and the big hole. The connection base 320 is extended into the sliding hole 310, the sliding board 330 is sliding connected to the ladder side of the sliding hole 310, a bolt 350 is run through the sliding board 330 and screwed with the connection base 320 to fix the connection base 320 and the sliding board 330 together, making the connection base 320 sliding relative to the sliding hole 310 in the X direction, the handle 100 and the outlet unit 200 formed a sliding connection relationship in the X direction, the obverse side of the handle 100 and the reverse side of the body 210 of the outlet unit 200 sealing connected together and the inlet hole connected to one of the outlet holes 211, 212. Preferred, the ladder side is disposed with two ball grooves 370 bilateral symmetry arranged in the two sides of the small hole, the ball groove is disposed with ball 360 inside, the sliding board 330 is connected to the ladder side through the ball 360 to transform the sliding friction to rolling friction. The cover 340 is coupled to cover to the sliding hole 310, it would be best that the reverse side of the cover 340 is parallel to the reverse side of the handle 100.

As requirement, the reverse side of the body 210 of the outlet unit 200 is concaved disposed with two limiting holes 250, 260 separately corresponding to the spray water and shower water. The obverse side of the handle is concaved disposed with a groove 150, which is disposed with a second spring 160 and a stop pin 170 withstood by the spring 160 to push one of the limiting holes 250, 260, the end of the stop pin 170 is hemispheroid.

Figure 3:
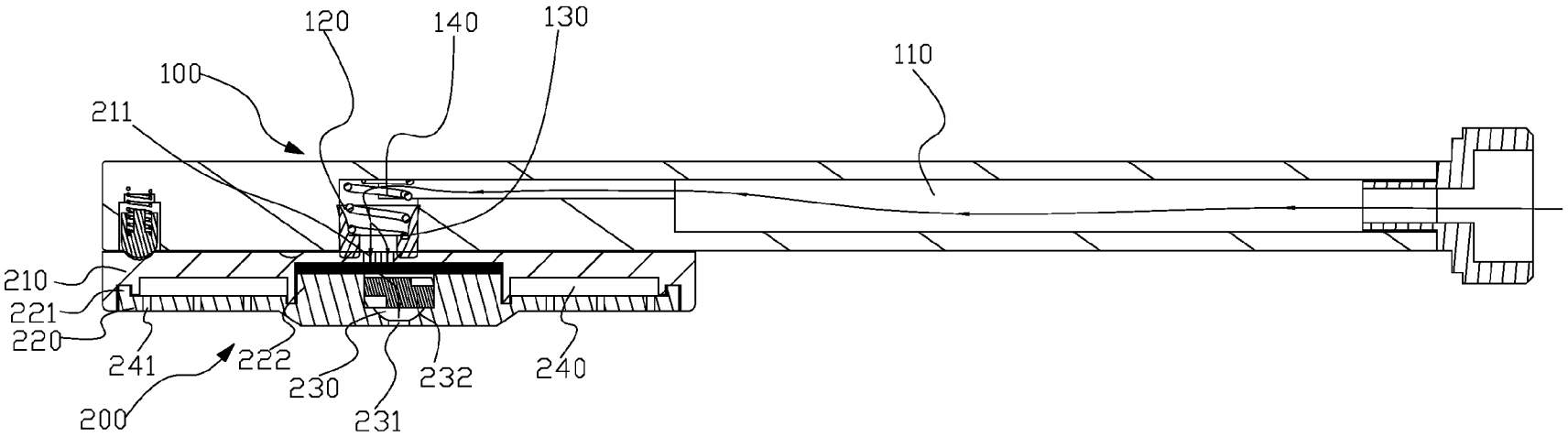
FIG. 3 illustrates the lengthwise sectional view of the first embodiment of the present invention when the shower with a sliding body is situated in spray function.
Figure 4:
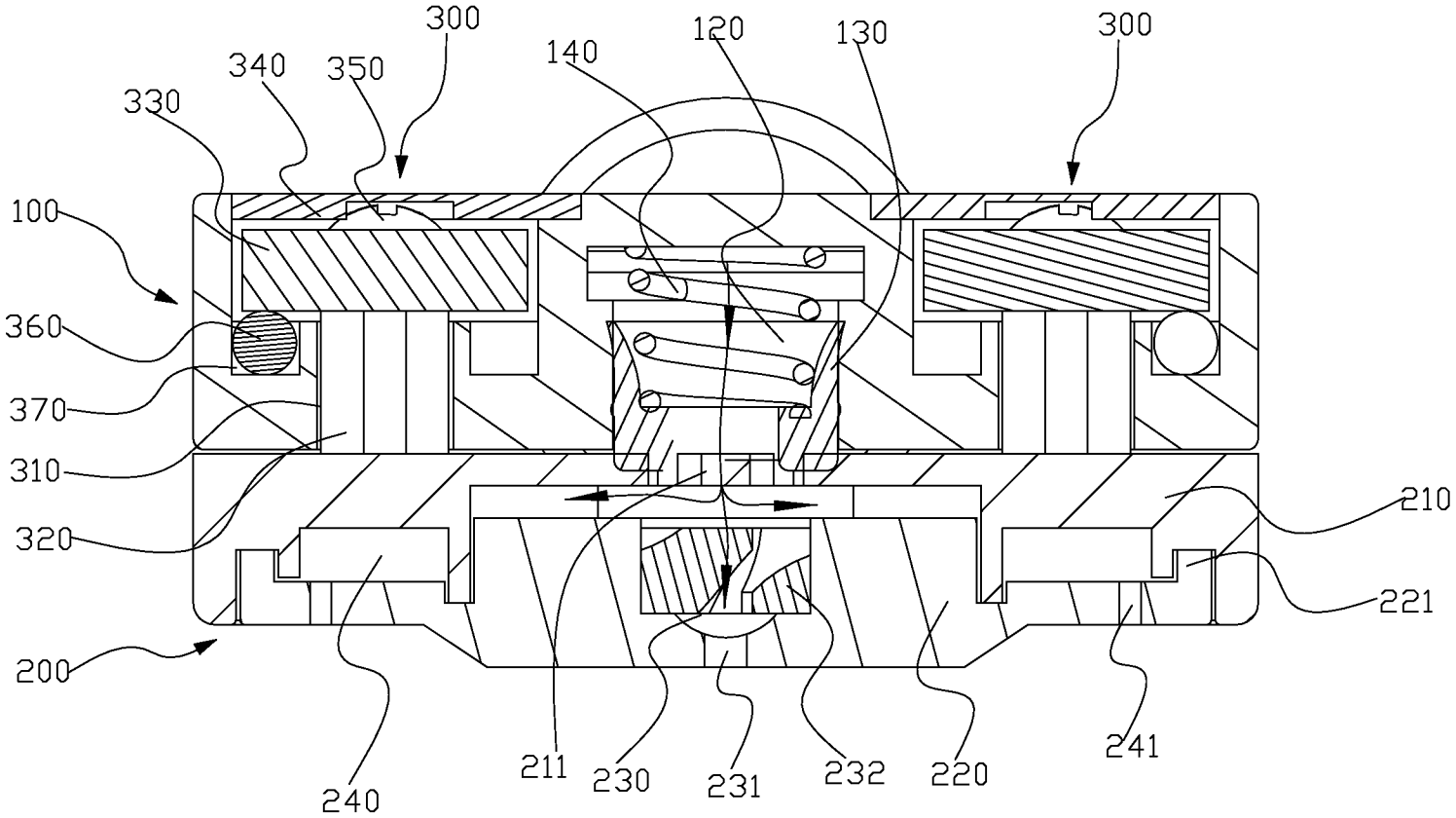
FIG. 4 illustrates the lateral sectional view of the first embodiment of the present invention when the shower with a sliding body is situated in spray function.

For the examiner further understanding the sliding switch of the shower with a sliding body, the switch process is detailed described. Please refer to the FIG. 3 and FIG. 4, the outlet unit 200 is located in the spray function, the leather cup 130 is parallel to the first outlet hole 121 and staggered with the second outlet hole 212, the flowing of the spray water is: water source, the plug base 400, the lengthwise waterway 110, the lateral waterway 120, the leather cup 130, the first outlet hole 211, the first outlet cavity 230, the first outlet nozzle 231, the spray water is spray out. Meanwhile, the stop pin 170 is withstood the limiting hole 250 under the stress of the second spring 160, making the outlet unit kept in the spray function and the spray water status.

Figure 5:
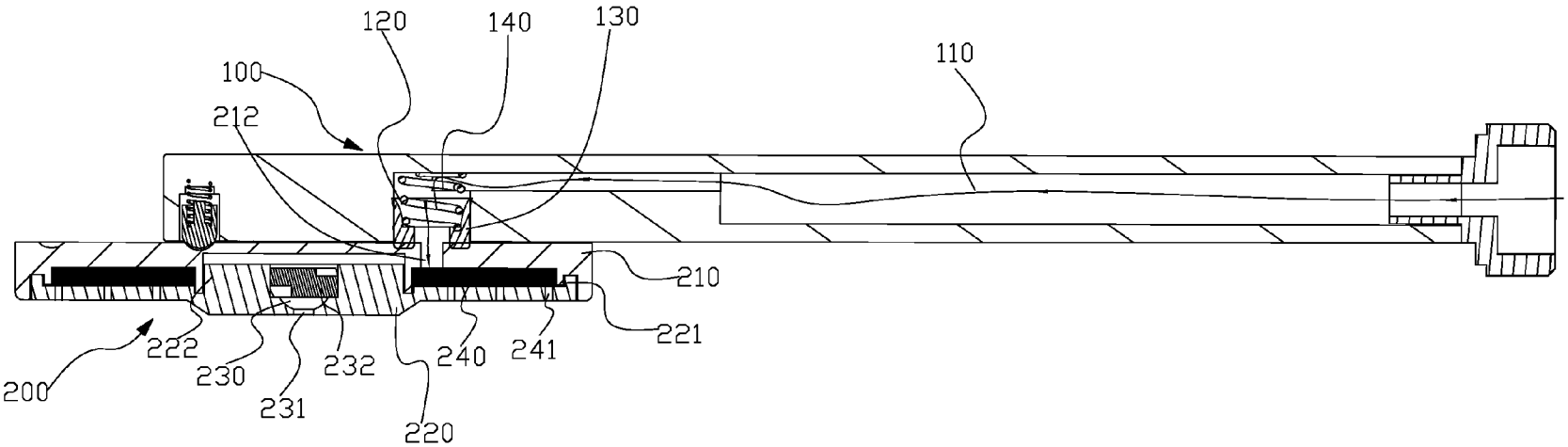
FIG. 5 illustrates the lengthwise sectional view of the first embodiment of the present invention when the shower with a sliding body is situated in shower function.

Please refer to the FIG. 5 and FIG. 6, the user forces the outlet unit 200, making the stop pin 170 disconnected from the limiting hole 250, the leather cup 130 staggered with the first outlet hole 211 and sliding along the X direction until the outlet unit 200 situated in the shower function and the leather cup 130 parallel to the second outlet hole 212, the flowing of the shower water is: the water source, the plug base 400, the lengthwise waterway 110, the lateral waterway 120, the leather cup 130, the second outlet hole 212, the second outlet cavity 240, the first outlet nozzle 241 with the shower water. Meanwhile, the stop pin 170 is withstood the limiting hole 260 with the effect of the second spring 160 to make the outlet unit kept in the shower function and the shower water status.

The Second Embodiment

Figure 7:
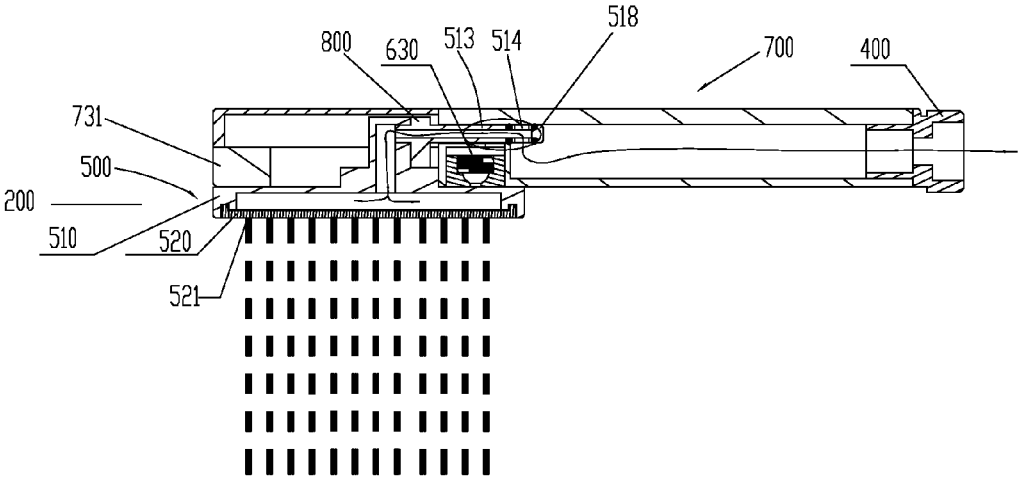
FIG. 7 illustrates the sectional view of the second embodiment of the present invention when the shower with a sliding body is situated in shower function.
Figure 8:
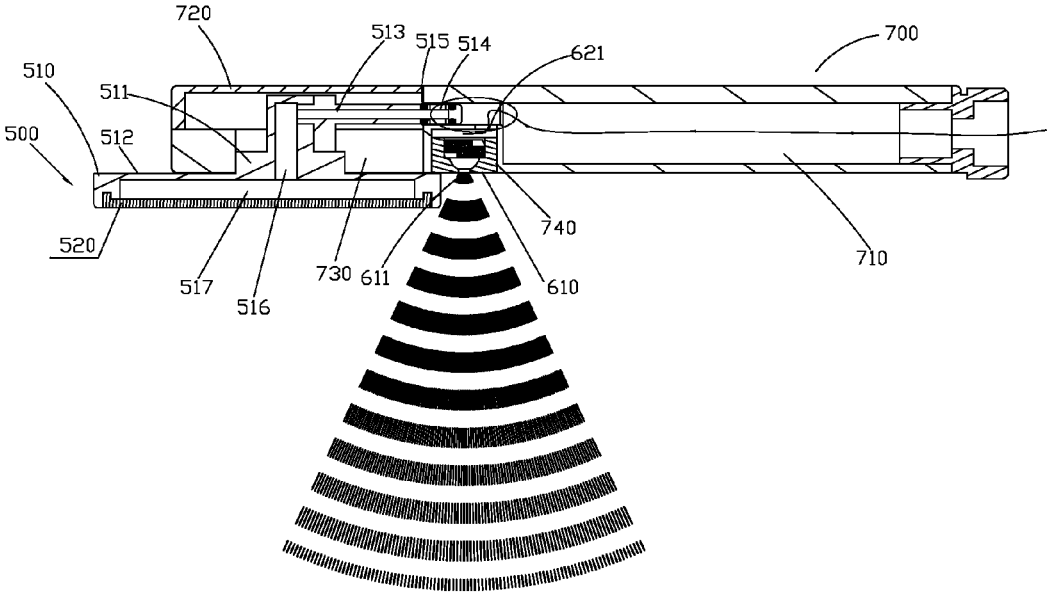
FIG. 8 illustrates the sectional view of the second embodiment of the present invention when the shower with a sliding body is situated in spray function.

Please refer to the FIG. 7 and FIG. 8, the structure of the shower with a sliding body is illustrated in the present invention.

The shower with a sliding body includes a handle 700, an outlet unit 200 and a connection mechanism 800.

The handle 700 is connected to the water source through the plug base 400, the handle 700 is disposed with an inlet waterway 710, the rear end of which is disposed with a fixed cavity 740, a movable cavity 730, a fasten cover 720 is disposed on the top of the movable cavity 730, a stop block 731 is disposed at the rear of the movable cavity 730.

The outlet unit 200 includes a fixed outlet unit and a sliding outlet unit 500.

The fixed outlet unit 600 disposed inside the fixed cavity 740 of the handle 700 is disposed in order with a small cover 610 and a deviator 630. the top wall of the fixed cavity is disposed with an inlet 621, the small cover 610 is disposed with outlet holes.

The sliding outlet unit 500 includes an outlet cover 520 and an upper cover 510. A connection base 511 is extended from the central of the cover body 512 of the upper cover 510. The end of the connection base 511 is laterally fixed with a sliding block 513, which can be a cylinder shaped. The front end of the sliding block 513 is disposed with a plug 518, the wall of the sliding block 513 is disposed with an inlet 513, the front end of the rear end of the inlet 513 are separately disposed with a seal 515.

The sliding outlet unit 500 is disposed inside the movable cavity 730 of the handle 700 and sliding connected to the handle 700 through the connection element 800.

For the examiner further understanding the sliding switch of the shower with a sliding body, the switch process is detailed described. Please refer to the FIG. 7, the outlet unit 200 is situated in the sliding outlet unit 500, the inlet 514 in the front end of the sliding block 513 is situated inside the inlet waterway 710 of the handle 700, the flowing of the shower water is: the water source, the plug base 400, the inlet waterway 710, the inlet 514, the outlet 516, the first outlet cavity 517, the first outlet nozzle 521 with the shower water.

Please refer to the FIG. 8, the user forces in the outlet unit 200 to make the connection base 511 of the sliding outlet unit 500 withstood the stop block 731 of the movable cavity 730, meanwhile, the sliding block 513 steps back to make the plug 518 in the front back to the rear of the upper of the fixed cavity 740 of the handle 700, the flowing of the shower water is: the water source, the plug base 400, the inlet waterway 710, the inlet 621 of the small cover, the second outlet cavity 640, the deviator 630, the second outlet nozzle 611 with the spray water.

The Third Embodiment

Figure 9:
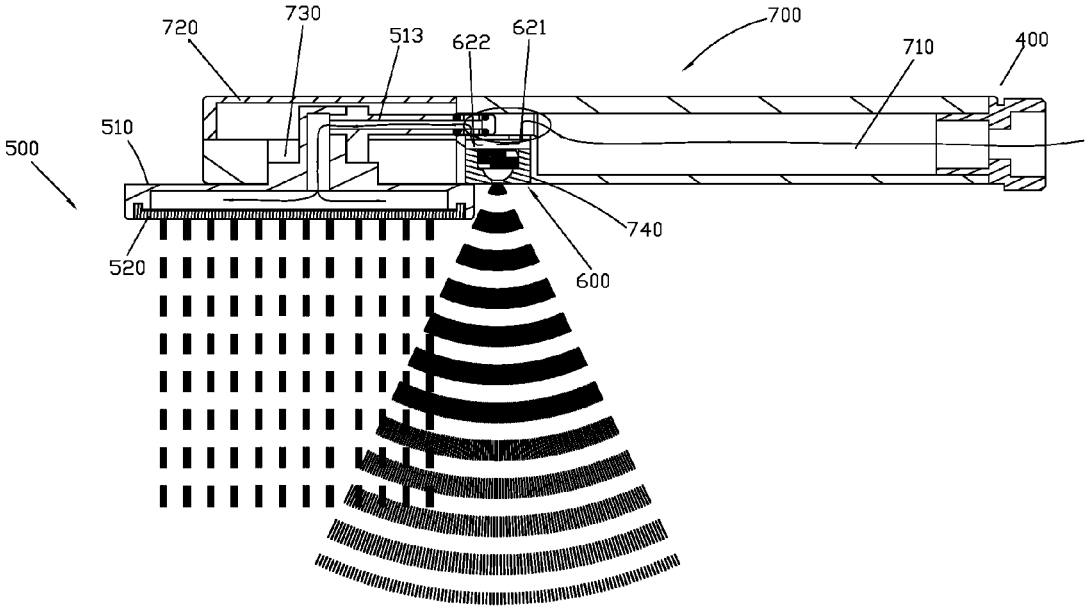
FIG. 9 illustrates the sectional view of the third embodiment of the present invention when the shower with a sliding body is situated in spray to function and shower function at the same time.

Please refer to the FIG. 9, the structure of the shower with a sliding body is illustrated in the present invention. The difference from the second embodiment in the third embodiment is that: the sliding outlet unit 500 is functional with the fixed outlet unit 600 simultaneously. The difference in the structure is that: the top wall of the fixed cavity 740 is disposed with an inlet 621 and an outlet 622 as well.

The step 1 of the process of the switch is the same with that of the second embodiment.

Step 2: the user forces in the outlet unit 200, making the connection base 511 of the sliding outlet unit 500 withstood the stop block 731 of the sliding cavity 730. Meanwhile, the sliding block 513 steps back to make the plug 518 in the front back to the rear of the upper of the fixed cavity 740 of the handle 700; the inlet 514 is connected to the outlet 622 of the fixed cavity of the small cover 610, the flowing of the spray water is: the water source, the plug base 400, the inlet waterway 710, the inlet 621 of the small cover; the first water flowing way is from the second outlet cavity 640, the deviator 630 to the second outlet nozzle 611 with the spray water; the other water flowing way is from the outlet 622, the inlet 514, the outlet 516 the first outlet cavity 517 to the first outlet nozzle 521 with shower water.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The present invention is provided with a shower with a sliding body, and the switch of the outlet functions is realized by the directly sliding of the outlet unit and the handle. The present invention without the pushing button and the linkage mechanism, reduces the cost and simplify the structure, providing a new switch experience for the user with well industrial applicability.

What is claimed is:

1. A shower with a sliding body, comprising:

a handle, which is provided with an inlet waterway, the inlet waterway is provided with an inlet hole disposed in an obverse side of the handle;

an outlet unit, which is provided with at least two outlets, each outlet is provided with an outlet hole disposed in a reverse side of the outlet unit, the outlet holes are interval disposed along a lengthwise direction; and a connection mechanism, which includes a sliding hole running through the obverse and a reverse side of the handle, staggering the sliding hole of the inlet waterway, a connection base raised on the reverse side of the outlet unit and a sliding board slip connected to the reverse side of the handle, wherein the handle is connected to the outlet unit with sliding along the lengthwise direction, the obverse side of the handle and the reverse side of the outlet unit are sealing connected together, the inlet hole is connected to one of the outlet holes the connection base extends into the sliding hole and is fixed to the sliding board, and the connection base slides relative to the sliding hole in the lengthwise direction.

2. The shower with a sliding body according to claim 1, wherein the inlet waterway includes a lengthwise waterway with one end connected to the water source, a lateral waterway is connected to the other end of the lengthwise waterway, the inlet hole is disposed in the lateral waterway;

a leather cup and an elastic body are disposed inside the lateral waterway, the leather cup is sliding connected to the lateral waterway, the elastic body is disposed inside the lateral waterway, withstanding the leather cup to make the leather cup hermetically contacting with the reverse side of the outlet unit.

3. The shower with a sliding body according to claim 2, wherein the sliding hole is a stepped hole, and the sliding board is sliding connected to the stepped plane of the stepped hole.

4. The shower with a sliding body according to claim 3, wherein the connection mechanism further includes a cover, which covers the sliding hole.

5. The shower with a sliding body according to claim 4, wherein the stepped plane is provided with a ball, and the sliding board is connected to the ball to transform sliding friction into rolling friction.

6. The shower with a sliding body according to claim 4, wherein the outlet unit includes a body and a cap, the periphery of the cap extends upwards to form an external wall, an inner base is fixedly disposed on the cap, which is sealing connected to the body to form a first outlet cavity in the inner base and a second outlet cavity between the inner base and the external wall, and the first outlet cavity and the second outlet cavity are separately connected to two outlet holes.

7. The shower with a sliding body according to claim 4, wherein the reverse side of the fixed unit is provided with limited holes corresponding to the outlets, and the obverse side of the handle is provided with a groove, which is provided with a spring and a stop pin withstanding one of the limited holes.

8. The shower with a sliding body according to claim 1, wherein the sliding hole is a stepped hole, and the sliding board is sliding connected to the stepped plane of the stepped hole.

9. The shower with a sliding body according to claim 8, wherein the connection mechanism further includes a cover, which covers the sliding hole.

10. The shower with a sliding body according to claim 9, wherein the stepped plane is provided with a ball, and the sliding board is connected to the ball to transform sliding friction into rolling friction.

11. The shower with a sliding body according to claim 9, wherein the outlet unit includes a body and a cap, the periphery of the cap is extended upwards to form an external wall, an inner base is fixedly disposed on the cap, which is sealing connected to the body to form a first outlet cavity in the inner base and a second outlet cavity between the inner base and the external wall, and the first outlet cavity and the second outlet cavity are separately connected to two outlet holes.

12. The shower with a sliding body according to claim 9, wherein the reverse side of the fixed unit is disposed with limited holes corresponding to the outlets, and the obverse side of the handle is provided with a groove, which is provided with a spring and a stop pin withstanding one of the limited holes.

13. A shower with a sliding body, comprising:

a handle, which is provided with an inlet waterway, the inlet waterway is provided with an inlet hole disposed in an obverse side of the handle;

an outlet unit, which is provided with at least two outlets; and a connection mechanism, which includes a sliding hole running through the obverse and a reverse side of the handle, staggering the sliding hole of the inlet waterway, a connection base raised on the reverse side of the outlet unit and a sliding board slip connected to the reverse side of the handle, wherein the handle is connected to the outlet unit with sliding along a lengthwise direction, the obverse side of the handle and a reverse side of the outlet unit are sealing connected together, the connection base extends into the sliding hole and is fixed to the sliding board, and the connection base slides relative to the sliding hole in the lengthwise direction.

14. A shower with a sliding body according to the claim 13, wherein the outlet unit includes a fixed outlet unit and a sliding outlet unit to form at least two outlets;

the fixed outlet unit is disposed in the fixed cavity of the handle, the sliding outlet unit is sliding connected to the sliding cavity of the handle.

15. A shower with a sliding body according to the claim 14, wherein the sliding outlet unit includes a sliding board, which is disposed with an inlet hole, the inlet hole is connected or disconnected to the inlet waterway to realize the switch of the outlets.

* * * * *